US009328980B1

(12) United States Patent
Doto

(10) Patent No.: US 9,328,980 B1
(45) Date of Patent: May 3, 2016

(54) RECEIVER LINK SEPARATOR

(71) Applicant: Jason William Doto, San Jose, CA (US)

(72) Inventor: Jason William Doto, San Jose, CA (US)

( * ) Notice: Subject to any disclaimer, the term of this patent is extended or adjusted under 35 U.S.C. 154(b) by 48 days.

(21) Appl. No.: 14/523,807

(22) Filed: Oct. 24, 2014

Related U.S. Application Data

(60) Provisional application No. 61/898,333, filed on Oct. 31, 2013.

(51) Int. Cl.
*F41A 21/00* (2006.01)
*F41A 3/66* (2006.01)

(52) U.S. Cl.
CPC ..... *F41A 3/66* (2013.01)

(58) Field of Classification Search
CPC ..... F41C 7/11; F41C 23/04; F41A 3/58; F41A 3/66; F41A 3/86; F41A 11/04; F41A 11/02; F41A 21/484
USPC ..... 42/75.01–75.04
See application file for complete search history.

(56) References Cited

U.S. PATENT DOCUMENTS 1,327,480 A * 1/1920 Kahl ..... A01B 61/02 280/452
1,379,574 A * 5/1921 Kahl ..... B60D 1/02 280/452
1,675,681 A * 7/1928 Wiese ..... F16B 45/00 278/96
2,232,997 A * 2/1941 Caldwell ..... B66C 1/00 294/82.35
3,843,160 A * 10/1974 Frushour ..... B60D 1/02 280/416.1
4,354,322 A * 10/1982 Carone ..... F41A 3/58 411/24
8,397,418 B2 * 3/2013 Cabahug ..... F41C 23/22 42/71.01
8,534,695 B2 * 9/2013 Columbia ..... B60D 1/02 280/504
2012/0137562 A1 * 6/2012 Langevin ..... F41C 23/04 42/75.03

* cited by examiner

*Primary Examiner* — Samir Abdosh
(74) *Attorney, Agent, or Firm* — Plager Schack LLP

(57) ABSTRACT

A receiver link separator is configured to separate an upper receiver from a lower receiver in a rifle. The receiver link separator has a first separation bracket upper post joined to a separation bracket lower post. A second separation bracket upper post can be joined to the separation bracket lower post. A locking pin can be inserted through the lower receiver and the separation bracket lower post. A clevis pin can be inserted through the upper receiver, the first separation bracket upper post and the second separation bracket upper post. The first separation bracket upper post and the second separation bracket upper post prevent the upper receiver from twisting away from the lower receiver.

5 Claims, 4 Drawing Sheets

RECEIVER LINK SEPARATOR

RELATED APPLICATION

This application claims priority to provisional patent application U.S. Ser. No. 61/898,333 filed on Oct. 31, 2013, the entire contents of which is herein incorporated by reference.

BACKGROUND

The embodiments herein relate generally to firearms and firearm accessories.

FIG. 8 shows rifle R as is known in the art. Rifle R comprises lower receiver L rotationally coupled to upper receiver U at pivot point P. Upper receiver U further comprises protrusion T have protrusion hole H that can be connected to lower receiver L with a locking pin through a plurality of locking pin holes O in lower receiver L. However, this rifle is difficult to clean. Once upper receiver U is rotated away from lower receiver L, it is easy for the two receivers to come back together, pinching the fingers of a human user. Embodiments of the present invention solve this problem.

SUMMARY

A receiver link separator is configured to separate an upper receiver from a lower receiver in a rifle. The receiver link separator has a first separation bracket upper post joined to a separation bracket lower post. A second separation bracket upper post can be joined to the separation bracket lower post. A locking pin can be inserted through the lower receiver and the separation bracket lower post. A clevis pin can be inserted through the upper receiver, the first separation bracket upper post and the second separation bracket upper post. The first separation bracket upper post and the second separation bracket upper post prevent the upper receiver from twisting away from the lower receiver.

In some embodiments, the first separation bracket upper post can further comprise a first separation bracket upper post hole configured to receive the clevis pin. The second separation bracket upper post can further comprise a second separation bracket upper post hole configured to receive the clevis pin. The separation bracket lower post can further comprise a separation bracket lower post configured to receive the locking pin. A hair spring clip can be inserted through the clevis pin so that the clevis pin cannot be pulled from the second separation bracket upper post hole.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
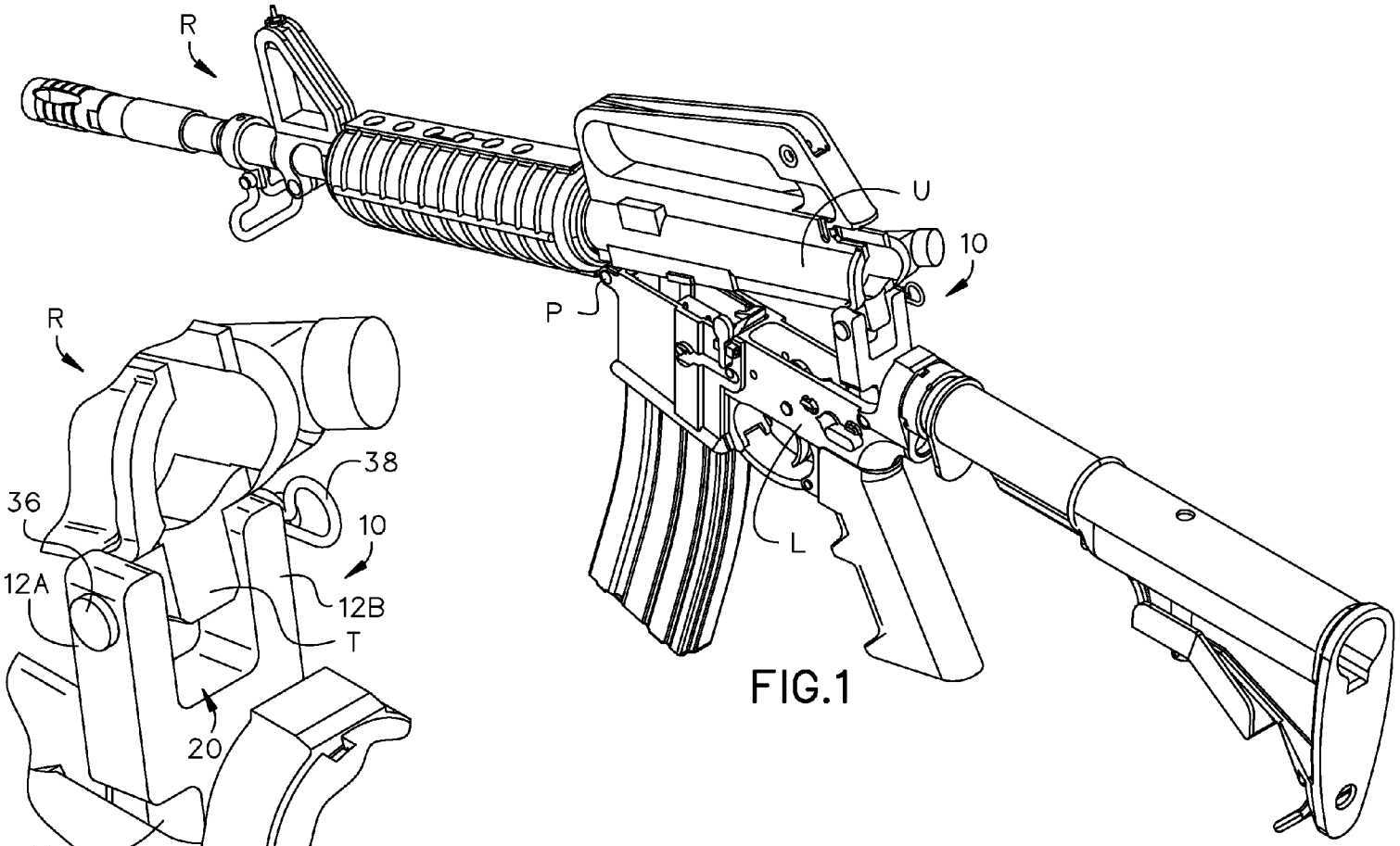
FIG. 1 is a perspective view of an embodiment of the invention shown in use.
Figure 2:
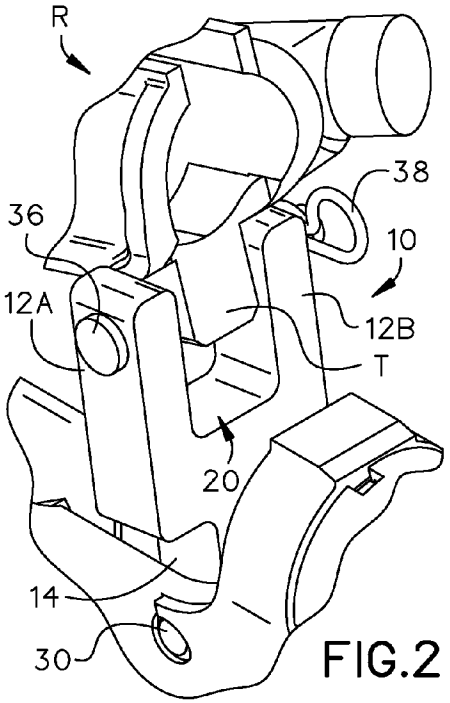
FIG. 2 is a detail perspective view of an embodiment of the invention shown in use.
Figure 3:
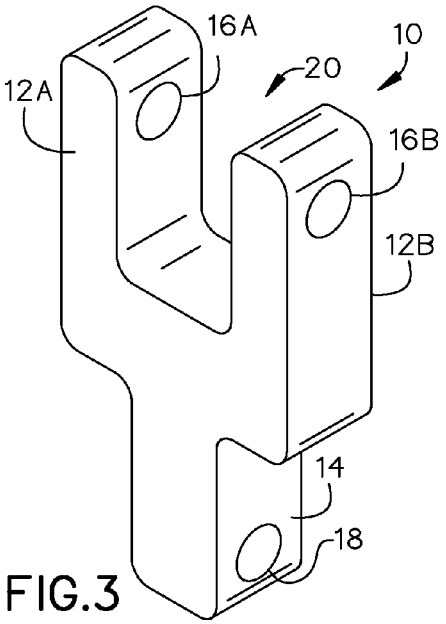
FIG. 3 is a perspective view of an embodiment of the invention.
Figure 4:
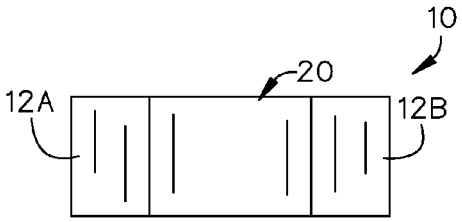
FIG. 4 is a top view of an embodiment of the invention.
Figure 5:
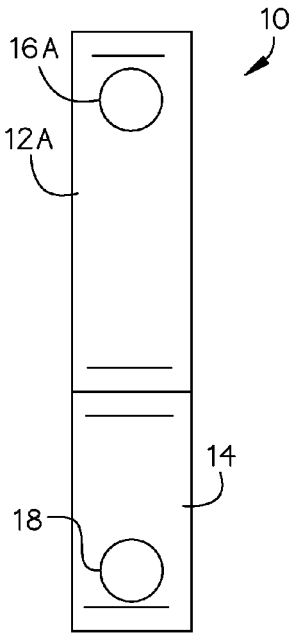
FIG. 5 is a side view of an embodiment of the invention.
Figure 6:
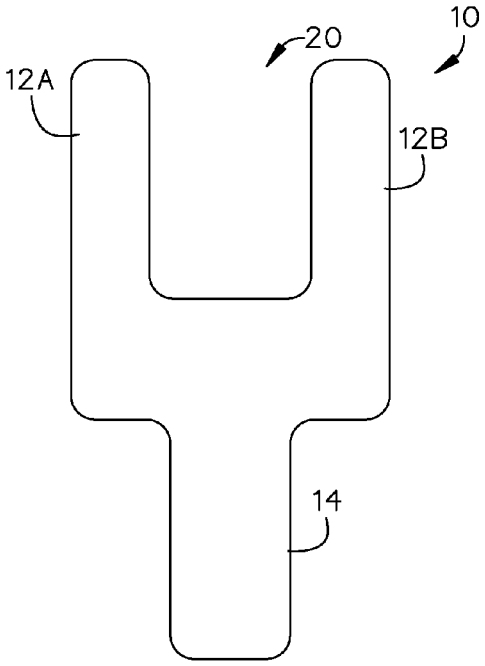
FIG. 6 is a front view of an embodiment of the invention.

By way of example, and referring to FIG. 1 and FIG. 2, one embodiment of receiver link separator 10 is configured to separate lower receiver L from upper receiver R to assist in cleaning rifle R. Receiver link separator 10 is shown in more detail in FIG. 3, FIG. 4, FIG. 5 and FIG. 6. A process for installing receiver link separator 10 into rifle R is shown in FIG. 7.

Turning first to FIG. 3, FIG. 4, FIG. 5 and FIG. 6, one embodiment of receiver link separator 10 comprises first separation bracket upper post 12A joined to separation bracket lower post 14. Separation bracket lower post 14 is joined to second separation bracket upper post 12B. First separation bracket upper post 12A further comprises first separation bracket upper post hole 16A. Likewise, second separation bracket upper post 12B further comprises second separation bracket upper post hole 16B. Separation bracket lower post 14 further comprises separation bracket lower post hole 18. First separation bracket upper post 12A is separated from second separation bracket upper post 12B with separation bracket center gap 20. Separation bracket center gap 20 is sufficiently large to accommodate protrusion T.

Figure 7:
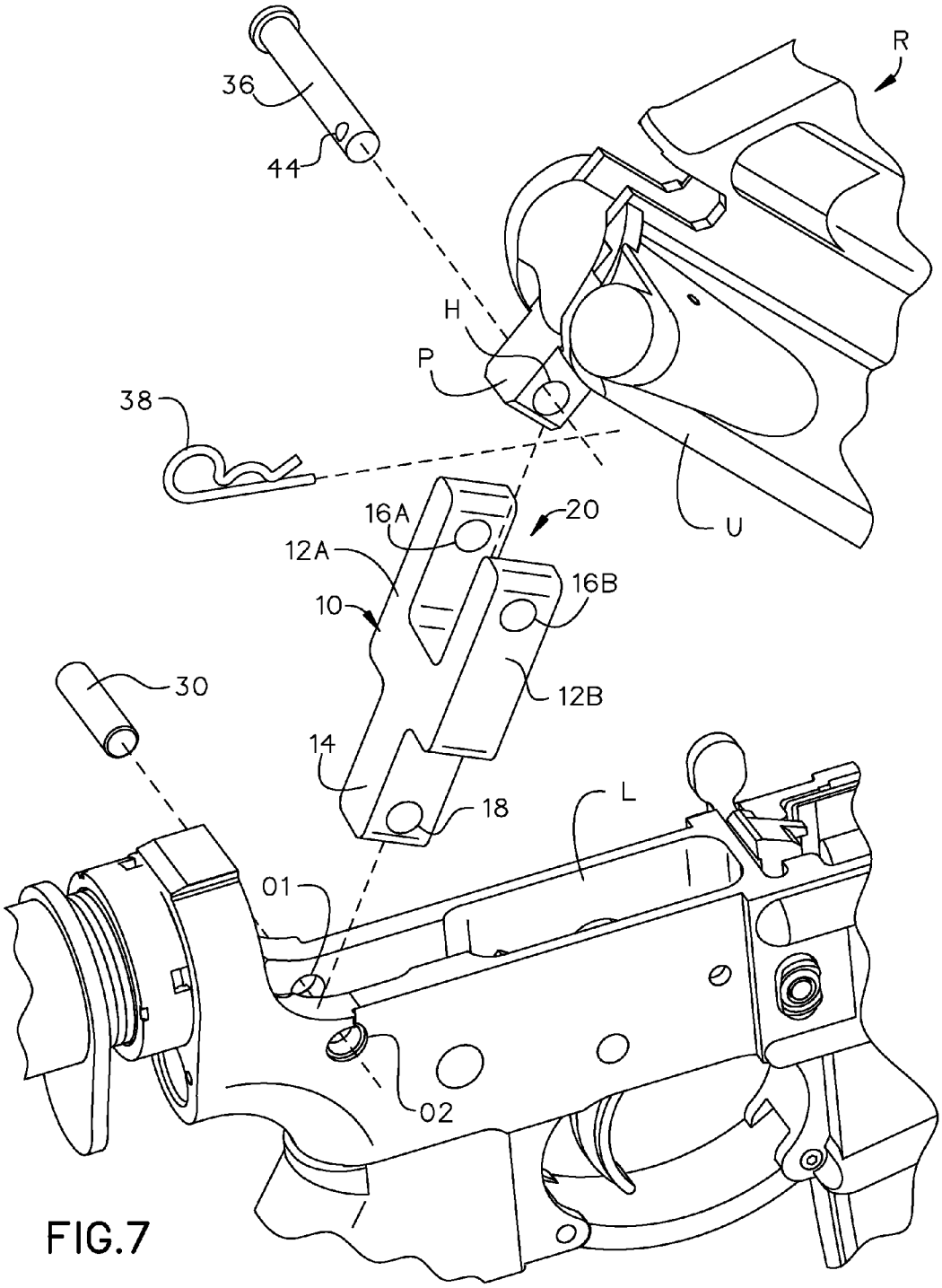
FIG. 7 is an exploded view of an embodiment of the invention.
Figure 8:
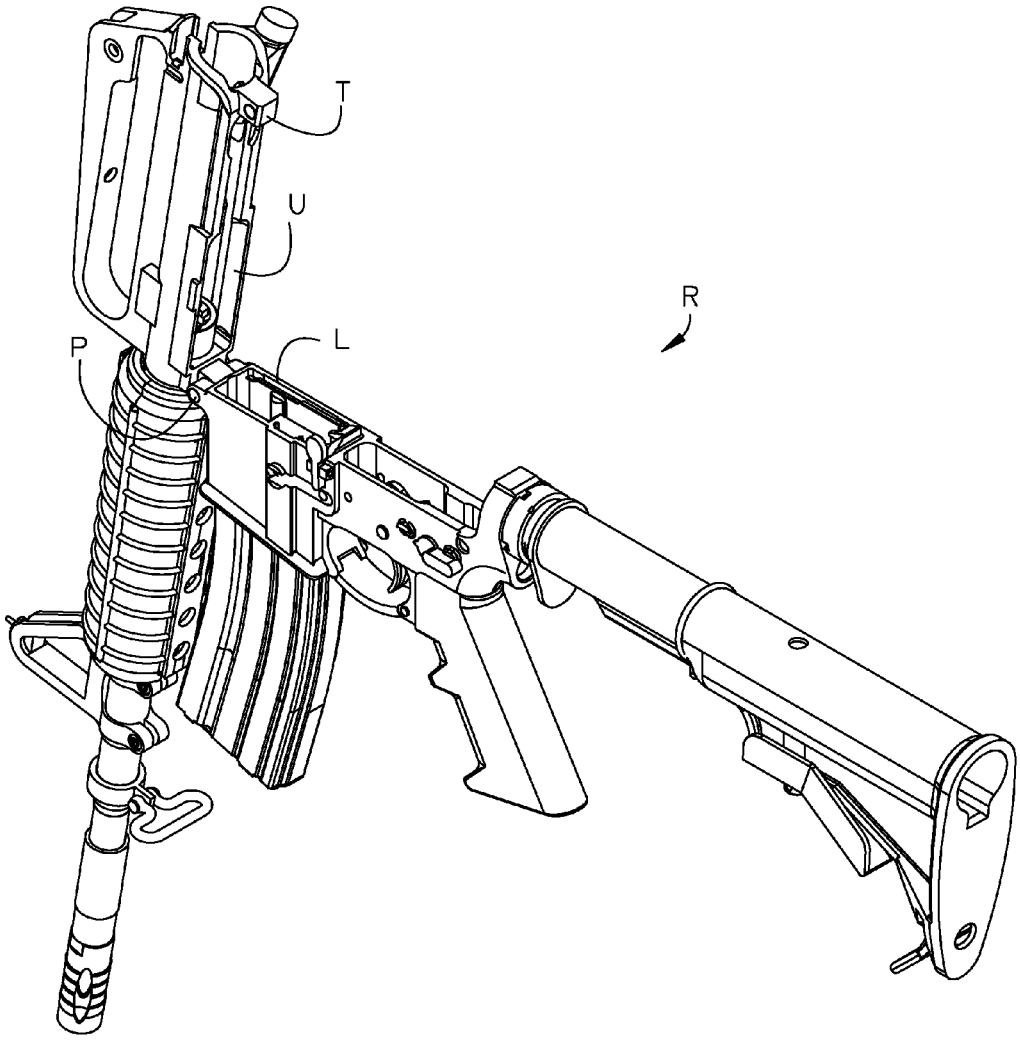
FIG.8 (PRIOR ART)
FIG. 8 is a prior art view demonstrating upper receiver over-pivot.

As shown in FIG. 7, to elevate upper receiver U from lower receiver L a user can begin by rotating upper receiver R from lower receiver L. Next, inserting locking pin 30 through first locking pin hole O1, separation bracket lower post hole 18 and second locking pin hole O1. Then, inserting clevis pin 36 having clevis pin hole 44 through first separation bracket upper post hole 16A, protrusion hole H and second separation bracket upper post hole 16B. Finally, inserting hair spring clip 38 through clevis pin hole 44.

First separation bracket upper post 12A and second separation bracket upper post 12B work together securely capture protrusion T and do not allow sideways movement that would otherwise unseat a single sided link. Clevis pin 36 is pushed through first separation bracket upper post hole 16A, protrusion hole H and second separation bracket upper post hole 16B such at one end of clevis pin 36 is larger than first separation bracket upper post hole 16A while a exposed end of clevis pin 36 protruding beyond second separation bracket upper post hole 16B has clevis pin hole 44 in it to accept hair spring clip 38. Hair spring clip 38 is then inserted through clevis pin hole 44 so clevis pin 36 cannot be pulled from second separation bracket upper post hole 16B. separation bracket lower post 14 is placed into a take-down recess of lower receiver L, then locking pin 30 is inserted through first locking pin hole O1, separation bracket lower post hole 18 and second locking pin hole O1 to secure link separator 10 to lower receiver L. Receiver link separator 10 acts as a solid strut that secures upper receiver U to lower receiver L thereby not allowing any pivot motion to occur and securing a human user's hands from pinching.

Embodiments of receiver link separator 10 can be made in known ways with known materials. However, a 2 or 3 axis milling machine, computer numerical controlled (CNC) mill, CNC router or CNC laser cutter were found to be effective. While any thickness may be effective, one half inch was found to be sufficiently strong while adequately easy to obtain an manufacture.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A receiver link separator, configured to separate an upper receiver from a lower receiver in a rifle; the receiver link separator comprising:

a first separation bracket upper post, joined to a separation bracket lower post;

a second separation bracket upper post, joined to the separation bracket lower post;

a locking pin, inserted through the lower receiver and the separation bracket lower post;

a clevis pin, inserted through the upper receiver, the first separation bracket upper post and the second separation bracket upper post;

wherein the first separation bracket upper post and the second separation bracket upper post prevent the upper receiver from twisting away from the lower receiver.

2. The receiver link separator of claim 1, wherein the first separation bracket upper post further comprises a first separation bracket upper post hole configured to receive the clevis pin.

3. The receiver link separator of claim 2, wherein the second separation bracket upper post further comprises a second separation bracket upper post hole configured to receive the clevis pin.

4. The receiver link separator of claim 3, wherein the separation bracket lower post further comprises a separation bracket lower post configured to receive the locking pin.

5. The receiver link separator of claim 4, further comprising a hair spring clip, inserted through the clevis pin so that the clevis pin cannot be pulled from the second separation bracket upper post hole.

* * * * *